US005233812A

United States Patent [19]

Coppola

[11] Patent Number: 5,233,812

[45] Date of Patent: Aug. 10, 1993

[54] POCKETED LETTER WITH IMAGED INSERT

[75] Inventor: Bruce Coppola, Merrick, N.Y.

[73] Assignee: UARCO Incorporated, Barrington, Ill.

[21] Appl. No.: 875,435

[22] Filed: Apr. 29, 1992

[51] Int. Cl.[5] ..... B65B 61/02; B65B 11/48; B65B 63/04

[52] U.S. Cl. ..... 53/411; 53/429; 53/460; 53/435; 493/216

[58] Field of Search ..... 53/460, 429, 206, 411, 53/435, 117, 520, 131.5, 131.4; 493/216

[56] References Cited

U.S. PATENT DOCUMENTS

| | | | |
|---|---|---|---|
| 3,618,284 | 11/1971 | Gendron | 53/460 X |
| 3,869,964 | 3/1975 | Kranz | 53/206 X |
| 3,894,905 | 7/1975 | Ehlscheid | 53/460 |
| 4,912,909 | 4/1990 | Stenner | 53/460 X |
| 5,031,382 | 7/1991 | Boyle | 53/460 X |

*Primary Examiner*—James F. Coan

*Attorney, Agent, or Firm*—Wood, Phillips, VanSanten, Hoffman & Ertel

[57] ABSTRACT

Jamming or wrinkling of inserts in a pocketed letter with an imaged insert may be avoided by a method of making a business form that includes the steps of providing a first ply (60) including a plurality of longitudinally spaced window forming die cuts (30,64), providing a second ply (72) which is narrower than the first ply (60) and having a plurality of longitudinally spaced variable information receiving spaces (36), one for each die cut (30), die cutting (at 78) the second ply (72) at locations corresponding to individual form lengths and transversely of the length of the ply (72), providing a third ply (80) having a width slightly greater than the second ply (72) and substantially less than the first ply (80), collating the plies (60,72,80) (at 88) such that the information receiving spaces (36) align with a corresponding one of the windows (30) and adhering with glue (40,42,48) the first and third plies together, and thereafter transversely cutting the plies (92) to form individual form lengths.

9 Claims, 3 Drawing Sheets

POCKETED LETTER WITH IMAGED INSERT

FIELD OF THE INVENTION

This invention relates to business forms, and more particularly, to a mailing piece that includes a pocket which may receive an imaged insert

BACKGROUND OF THE INVENTION

In U.S. Pat. No. 4,925,086 issued May 15, 1990 to Harold E. Stahlman, there is disclosed a so-called "response letter". The response letter includes a letterhead-like section including a die cut window near the upper edge. A partial panel extending to one side of the letterhead is folded over and adhered to the back of the letterhead in such a way as to form a pocket behind the die cut window. Thereafter, a mechanical inserter inserts a card into the pocket such that some desired piece of information, such as a name and address or the like, appear through the die cut window.

The letterhead may then be folded with the insert within the pocket and stuffed in an envelope and mailed to the desired recipient. Upon opening the envelope, the recipient may remove the letterhead and read its contents. The insert may be removed from the pocket and utilized as a means of responding to the message contained on the letterhead.

A business form of this type, while susceptible to many desirable uses in connection with promotions of one or another, is not without several difficulties. For one, because the projecting panel must be folded over the back of the letterhead and is only about one third the size of the letterhead, the blank of which the letterhead and panel is formed is irregularly shaped. Consequently, to form the blank, approximately one third of the paper required for each blank must be discarded at a considerable cost.

Secondly, in the specific construction of the Stahlman patent, the insert is physically inserted into the already formed pocket. If this operation is not accomplished properly, there is the possibility of jamming, a factor that does not lend itself to high speed production. Alternatively, there may be wrinkling of the insert. In the case of the latter, the recipient receives a mailing piece of less than top quality which in turn may bear upon the degree of interest the recipient exercises with respect thereto. In the case of the former, that is, jamming, because many of the inserts may receive so-called variable information which is unique to an individual insert and none others, the jamming or partial or entire destruction of an insert destroys a unique piece of correspondence which can only be regenerated by slipping out of an automated printing sequence to recapture computer information that has already been once processed.

The present invention is directed to overcoming one or more of the above problems.

SUMMARY OF THE INVENTION

It is the principal object of the invention to provide a new and improved business form such as a pocketed letter with an imaged insert. More specifically, it is an object of the invention to provide such a pocketed letter that may be fabricated with minimum material usage and very little wastage, and further, without the possibility of jamming or wrinkling of the insert during the assembly process.

According to the invention, there is provided a new and improved method of making a business form of the type including a letterhead having a window opening near one end thereof with a pocket formed behind the window opening and an insert received within the pocket such that some desired part thereof is exposed through the window. The method includes the steps of (a) providing a first ply having a plurality of longitudinally spaced window forming die cuts, each corresponding to one form length of the ply; (b) providing a second ply which is narrower than the first ply and having a plurality of longitudinally spaced variable information receiving spaces, one for each of the die cuts; (c) die cutting the second ply at locations corresponding to individual form lengths transversely of the length of the ply; (d) providing a third ply having a width slightly greater than the second ply and substantially less than the first ply; (e) collating the plies such that the information receiving spaces align with a corresponding one of the windows and adhering the first and third plies together through the die cuts resulting from step (c) and at one longitudinal edge of the third ply that is located between longitudinal edges of the first ply; and (f) transversely cutting the plies at the die cuts resulting from step (c) to form individual form lengths.

In a preferred embodiment, each of the plies has at least one control punch margin along at least one longitudinal edge and step (e), the step of collating, is accomplished by collating the plies at the control punch margins. In addition to transversely cutting the plies to form individual form lengths, step (f) includes the step of removing the control punch margins.

In a preferred embodiment, the width of the third ply is approximately one third the width of the first ply after the performance of step (f).

The invention contemplates that step (f) be followed by the steps of folding each individual form length into three panels and thereafter inserting the folded form length into an envelope. In a highly preferred embodiment, the step of folding is performed such that variable information in the variable information receiving space is visible without unfolding each form length and the step of inserting is performed by inserting each form length in a window envelope such that the corresponding information receiving space is aligned with the window of the envelope in which it is received.

According to a highly preferred embodiment, the step of providing the first ply includes the step of forming a second die cut in the first ply for each form length and at a location abutting the control punch margin so that removal of the control punch margin will expose the second die cuts so that the same may act as thumb notches.

This method also contemplates that the step of collating and adhering be in part performed by applying U-shaped lines of adhesive to at least one of the first and third plies in partial surrounding relation to each individual form length of the second ply.

Other objects and advantages will become apparent from the following specification taken in connection with the accompanying drawings.

DESCRIPTION OF THE PREFERRED EMBODIMENT

Figures 1, 2, 3:
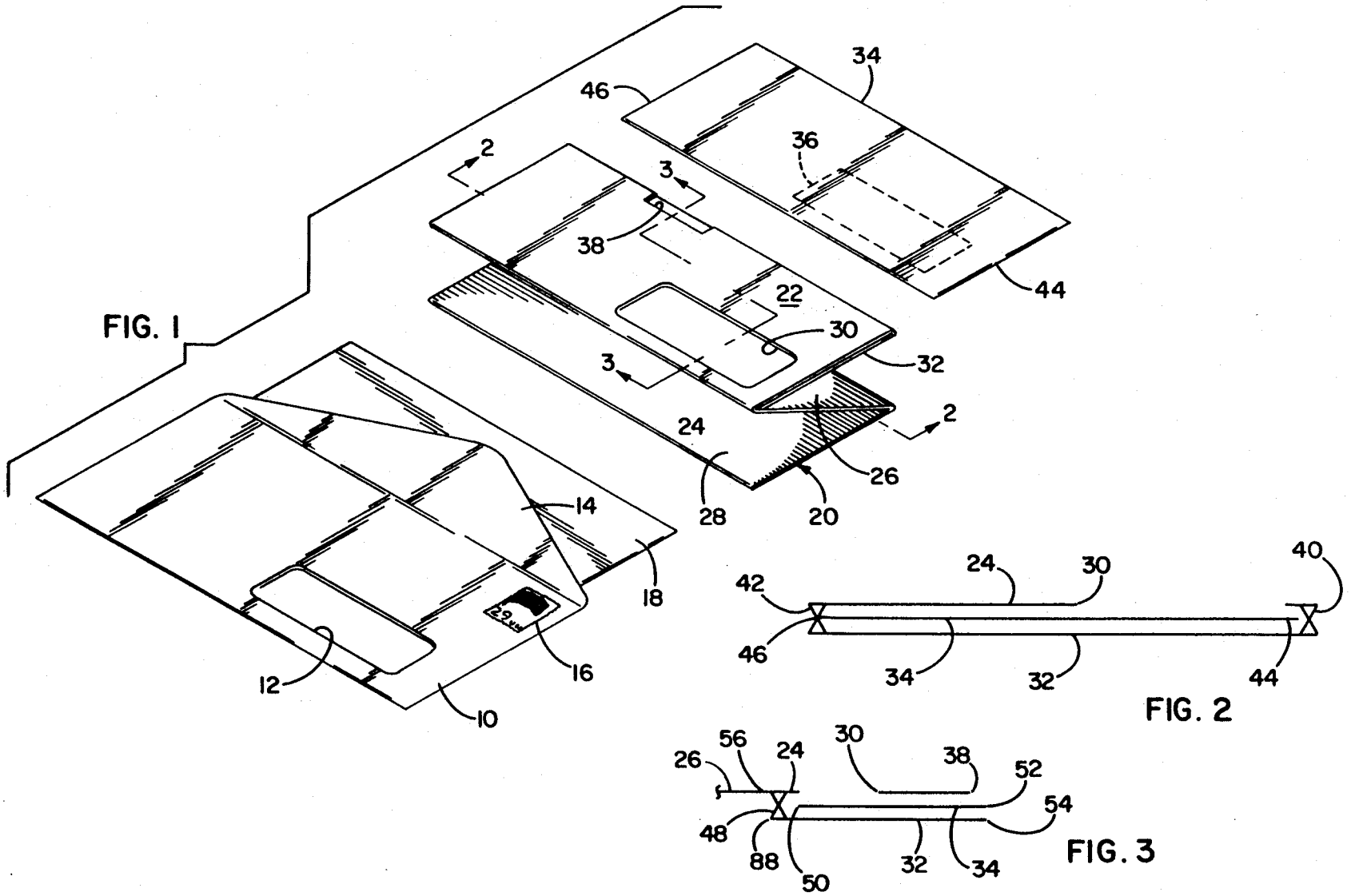
FIG. 1 is an exploded view of a complete mailing piece which in turn may receive a pocket letter with an imaged insert made according to the invention.
FIG. 2 is a schematic, sectional view taken approximately along the line 2—2 in FIG. 1.
FIG. 3 is a schematic, sectional view taken approximately along the line 3—3 in FIG. 1.

An exemplary embodiment of a mailing piece including a pocketed letter with imaged insert and made according to the method of the present invention is illustrated in FIG. 1. The mailing piece includes a conventional top flap envelope 10. Preferably, the envelope 10 is a window envelope and includes a window 12 in the face thereof along with a flap 14 by which the contents of the envelope 10 may be sealed therein. The face of the envelope 10 also includes a stamp or pre-printed franking indication shown at 16.

Various types of insert material shown at 18 in FIG. 1 may be stuffed within the envelope 10 in a conventional fashion. The insert material may include promotional material, a return envelope, or both.

Also stuffed within the envelope 10 is a pocketed letter with imaged insert, generally designated 20, and made according to the invention. The pocketed letter 20 is in the form of a letterhead 22 folded in three panels 24, 26 and 28, all of approximately equal size as is conventional. The panel 24 is the uppermost panel on the letterhead and includes a die cut window 30 therein. The panel 24 is backed by a pocket forming panel 32 formed as will be seen. The resulting pocket is closed about three sides and is open at the top of the letterhead 22. An imaged insert 34 is located in the pocket as the pocket is formed The insert 34 includes an area 36 which is particularly adapted for receipt of so-called variable information while the remainder of the insert 34, both front and back, may receive fixed information.

The area 36 is located so as to underlie the window 30 in the panel 24 and the window 30 is in turn located so as to align with the window 12 when the pocketed letter 20 is disposed in the envelope 10.

As is well known, so-called fixed information is information that does not vary from one form length to the next. On the other hand, variable information is that which frequently, if not always, varies from one form length of a business form to the next, depending upon the intended recipient. One example of fixed information would be the letterhead information that typically would be affixed to the panel 24. One example of variable information would be the name and address of the intended recipient of the mailing piece If the salutation is of the "Dear Sir or Madam" variety, it will most likely be printed on the letter 20 as fixed information whereas if the salutation is directed to a specific person or persons such as "Mr. & Mrs. Gomer Hofeldt", it will printed as variable information.

The imaged insert 20 is completed by a notch 38 formed by a die cut at the upper edge of the panel 24. The notch 38 allows one to readily extract the insert 34 from the pocket through use of the fingers and/or thumb.

Turning now to FIG. 2, the panel 24 is seen to include the die cut opening 30. Underlying the die cut opening 30 and extending to the longitudinal edges of the panel 24 is the pocket forming panel 32.

The panel 32 is adhered to the panel 24 by a U-shaped glue line, parts of which are schematically illustrated at 40 and 42.

Between the glue line parts 40 and 42 as well as between the panels 24 and 32 is the insert panel 34. It will be noted that the longitudinal edges 44 and 46 of the panel 34 stop short of the glue 40, 42.

FIG. 3 illustrates the same part of the assemblage but from a direction approximately 90° with respect to FIG. 2. Again, the pocket forming panel 32 is seen to be adhered by a glue line part 48 to the panel 24 of the letterhead 22. The edge of the die cut 30 is seen along with an edge of the notch 38. The insert panel 34 is contained between the panels 30 and 32 and its lowermost edge 50 stops short of the glue line part 48. Its uppermost edge 52 extends beyond the bottom of the notch 38 to be exposed and into approximate alignment with a corresponding edge 54 of the panel 32. While not a technically correct showing, FIG. 3 illustrates by a hash line 56 the fold that would separate the panel 24 from the panel 26 solely for illustrative purposes.

Figure 4:
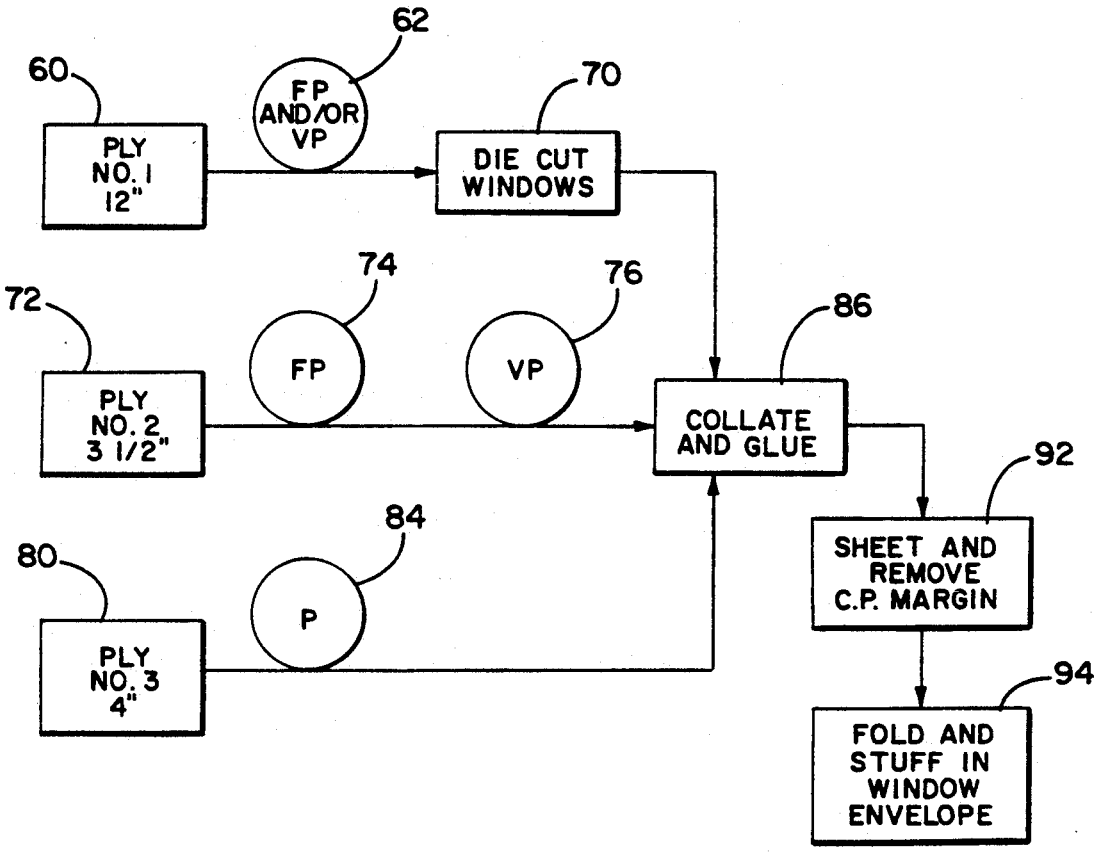
FIG. 4 is a flow diagram illustrating the steps of the method of the invention.
Figure 5:
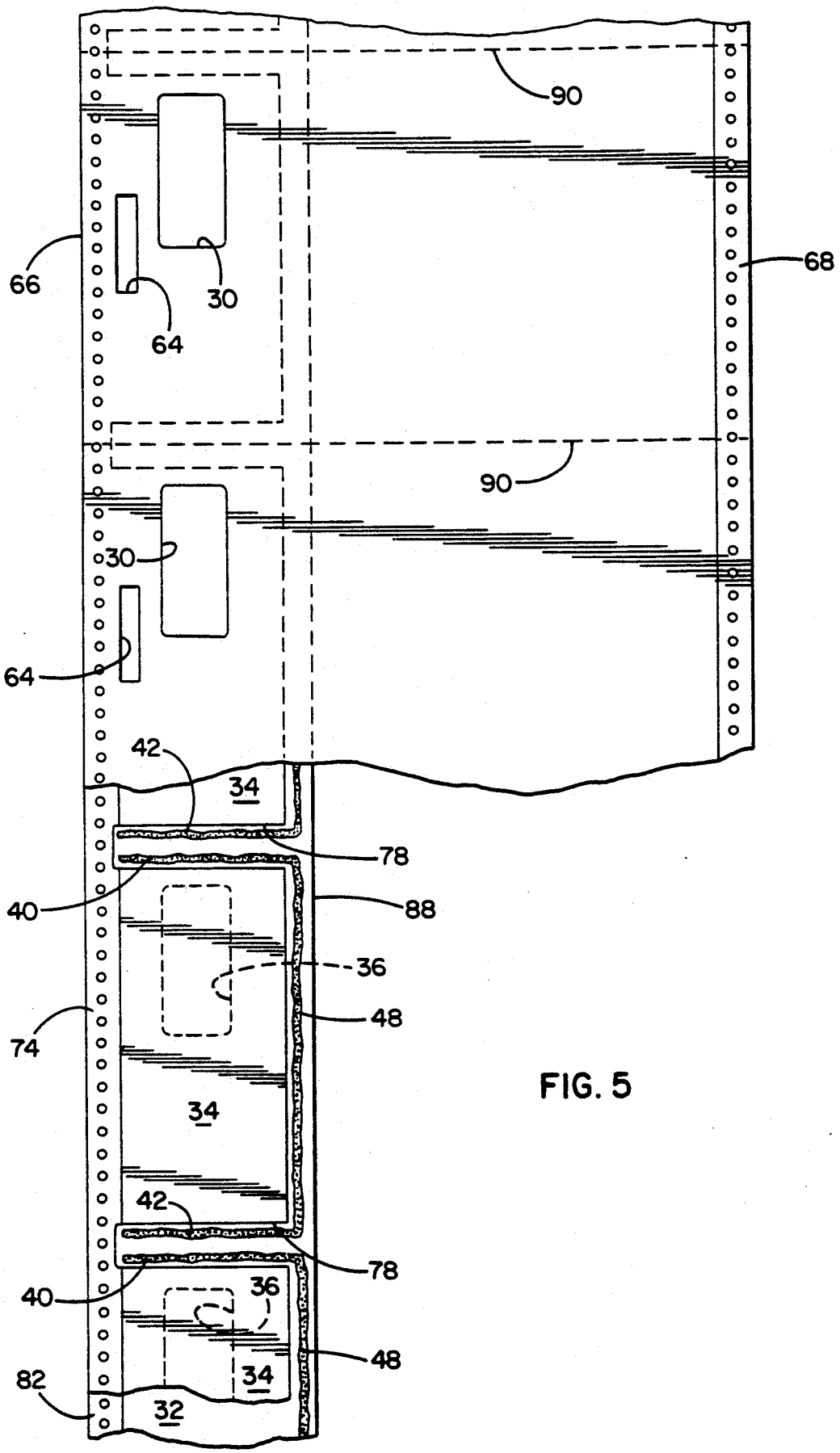
FIG. 5 is a fragmentary plan view of a pocketed letter with an imaged insert made according to the method of the present invention prior to the separation of the letter components into individual form lengths and with parts broken away for clarity.

Turning now to FIGS. 4 and 5, the method of forming the construction will be described. The letterhead 22 is formed by a first ply which, as is well known, will be an elongated ply of paper several hundred feet in length. As indicated in FIG. 4 at a box 60, where the letterhead is to be an $8\frac{1}{2} \times 11$ letterhead, the first ply will be approximately 12 inches in width and provided with so-called control punch margins, each of approximately one half of an inch in width each of its longitudinal edges. This ply is run through a printing press 62 and information printed thereon.

The information printed on the first ply can be either fixed information, variable information, or both. In the usual case, it is highly preferred to provide the ability to print variable information on this ply. Specifically, this ply constitutes what might be termed the "letter portion" of the mailing piece. The capability to print variable information on the "letter portion" allows personalization of the pieces in a mass mailing for each intended recipient. Thus, each piece appears more intimate to the recipient than where only fixed information is employed and a substantial commercial advantage is realized.

At the same time, the die cut 30 as well as a smaller die cut 64 (FIG. 5), are formed in each form length of the first ply. As can be appreciated from FIG. 5, the die cuts 30 and 64 are elongated with their direction of elongation running in the direction of elongation of each ply. It will also be appreciated that the respective die cuts 30 and 64 are longitudinally spaced from their counterparts on each form length and laterally spaced from each other on a given form length. Finally, it will be appreciated that each of the die cuts 64 slightly overlaps into the adjacent control punch margin 66 which, in the embodiment illustrated, is the left-hand control punch margin. The right-hand control punch margin is illustrated at 68. Summarizing then, the die cuts 30 and 64 are performed at the block marked 70.

Also provided, as shown at a block 72, is a second elongated ply. The second ply ultimately provides the insert 34 and will typically have a dimension transverse to its length of approximately $3\frac{1}{2}$ inches, including a $\frac{1}{2}$ inch control punch margin 74 on its left-hand side. In the usual case, the second ply will be run through a printing press schematically shown at 74 such that the fixed information that is to be received on the insert 34 is printed thereon. Thereafter, the second ply is run through a second printer such as a laser printer 76 at which time the variable information may be printed in the area 36 of each form length. The laser printer 76 may in fact be contained in part of a collator if desired.

At or about the same time, as best seen in FIG. 5, die cuts 78 which delimit each form length of the second ply are formed transversely across the ply to completely sever the same except that the control punch margin 74 is left intact. The die cuts 78 do however partially extend into the control punch margins 74.

The die cutting that results in the die cuts 78 may also be performed in a collator.

Also provided is a third elongate ply as indicated at a box 80. The third ply is considerably narrower than the first ply and slightly wider than the second ply. In the exemplary embodiment, it is about four inches wide, including a half inch control punch margin 82 (FIG. 5) on its lefthand edge. To the extent that any fixed of variable printing is required or desired on the third ply which forms the pocket forming panel 32, that is accomplished in a printing press 84 (FIG. 4).

The resulting plies are then brought together in a conventional collator and glued together as shown at a block 86. U-shaped glue lines partially surround each form length of the second ply that defines one of the inserts 34 as can be seen in FIG. 5. That is to say, the glue line parts 40 and 42 extend into the die cuts 78 delimiting each form length of the insert 34 and are connected by the glue line parts 48 which extend along the marginal edge 88 of the third ply which provides the pocket forming panel 32. In these locations, the glue lines may be contacted by the first ply, that is, the underside of the panel 24 between the longitudinal margin of the first ply and a U-shaped pocket with the insert 34 already in place is thus formed.

Following the collating and gluing step 86, the resulting assemblage is transversely cut at the location of dotted lines 90 which are aligned with each of the die cuts 78 and extend between the glue line parts 40 and 42 in each die cut 78. This divides the form into individual form lengths. At the same time, the control punch margins 66, 68, 74 and 82 are removed. These steps are shown at 92 in FIG. 4. When the control punch margins 66, 74 and 82 are removed, adjacent insert panels 34 are freed from one another by reason of the die cut 78 extending into, though not through, the control punch margin 74. In addition, the windows 64 are opened to become the notches 38 since they slightly overlap the control punch margin 66.

Following the removal of the control punch margins and the severing of the assembly into individual form lengths, the pocketed letter 20 may be folded and stuffed into the window envelope 10 along with such other insert material 18 as may be desired as shown at 94.

From the foregoing, it will appreciated that a pocketed letter with an imaged insert made according to the method of the invention is formed with very little wastage in comparison to prior art structures. The only material not contained in the finished form is that utilized to form the control punch margin and the various die cuts. Because the widths of the various plies may be sized essentially according to their finished size, other than for removal of the control punch margins which are necessary in the manufacturing operation, there is essentially no waste involved.

Furthermore, because the insert panels 34 are collated between the first and third plies according to conventional and well known collating techniques, difficulties heretofore encountered with jamming of the inserts during an insertion process and/or wrinkled inserts are completed avoided. Consequently, the pocketed letter of the invention lends itself to high speed manufacture of a highly automated nature.

I claim:

1. A method of making a business form comprising the steps of:

a) providing a first ply having a control punch margin along at least one longitudinal edge and a plurality of longitudinally spaced window forming die cuts, each corresponding to one form length of said ply;

b) providing a second ply having a control punch margin along a longitudinal edge, said second ply being narrower than said first ply and having a plurality of longitudinally spaced variable information receiving spaces, one for each said die cut;

c) die cutting said second ply at locations corresponding to individual form lengths transversely of the length of the ply while leaving said control punch margin intact;

d) providing a third ply having a control punch margin along a longitudinal edge, said third ply having a width slightly greater than said second ply and substantially less than said first ply;

e) collating said plies at said control punch margins such that said information receiving spaces align with a corresponding one of said windows and adhering said first and third plies together through the die cuts resulting from step c) and at an edge of said third ply remote from the control punch margin thereon; and f) removing said control punch margins and transversely cutting said plies at the die cuts resulting from step c) to form individual form lengths.

2. The method of claim 1 wherein step e) is preceded by the step of imprinting variable information in said information receiving spaces.

3. The method of claim 1 wherein the width of said third ply is approximately ⅓ the width of said first ply after the performance of step f).

4. The method of claim 3 wherein step f) is followed by the steps of g) folding each individual form length into three panels and h) inserting the folded form length into an envelope.

5. The method of claim 4 wherein step g) is performed such that variable information in said variable information receiving space is visible without unfolding each form length and step h) is performed by inserting each form length in a window envelope such that the corresponding information receiving space is aligned with the window of the envelope in which it is received.

6. The method of claim 1 where step a) includes the step of forming a second die cut in said first ply for each form length at a location abutting said control punch margin so that removal of the control margin will expose said second die cut to act as thumb notches.

7. The method of claim 1 wherein step e) is in part performed by applying U-shaped lines of adhesive to at least one of said first and third plies in partial surrounding relation to each individual form length of said second ply.

8. A method of making a business form comprising the steps of:

a) providing a first ply having a plurality of longitudinal spaced window forming die cuts, each corresponding to one form length of said ply;

b) providing a second ply which is narrower than said first ply and having a plurality of longitudinally spaced variable information receiving spaces, one for each said die cut;

c) die cutting said second ply at locations corresponding to individual form lengths transversely of the length of the ply;

d) providing a third ply having a width slightly greater than said second ply and substantially less than said first ply;

e) collating said plies such that said information receiving spaces align with a corresponding one of said windows and adhering said first and third plies together through the die cuts resulting from step c) and at one longitudinal edge of said third ply located between the longitudinal edges of said first ply; and f) transversely cutting said plies at the die cuts resulting from step c) to form individual form lengths.

9. A method of making a business form comprising the steps of:

a) providing a printed first ply having a control punch margin along at least one longitudinal edge and a plurality of longitudinally spaced window forming die cut pairs each pair corresponding to one form length of said ply;

b) providing a printed second ply having a control punch margin along a longitudinal edge, said second ply being considerably narrow than said first ply and having a plurality of longitudinally spaced variable information receiving spaces, one for each said die cut pair, and printing variable information in each said space;

c) die cutting said second ply at locations corresponding to individual form lengths transversely of the length of the ply while leaving the control punch margin thereof intact;

d) providing a third ply having a control punch margin along a longitudinal edge, said third ply having a width slightly greater than said second ply and substantially less than said first ply;

e) collating said plies at said control punch margin such that said information receiving spaces align with a corresponding one of said windows in each said pair and adhering said first and third plies together through the die cuts resulting from step c) and at an edge of said third ply remote from the control punch margin thereon; and f) removing said control punch margins to intersect the other die cut of each said pair and transversely cutting said plies at the die cuts resulting from step c) to form individual form lengths.

* * * * *